US008050433B2

(12) United States Patent
Kim

(10) Patent No.: US 8,050,433 B2
(45) Date of Patent: Nov. 1, 2011

(54) APPARATUS AND METHOD TO CANCEL CROSSTALK AND STEREO SOUND GENERATION SYSTEM USING THE SAME

(75) Inventor: Sun-min Kim, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1471 days.

(21) Appl. No.: 11/507,483

(22) Filed: Aug. 22, 2006

(65) Prior Publication Data

US 2007/0076892 A1 Apr. 5, 2007

Related U.S. Application Data

(60) Provisional application No. 60/720,043, filed on Sep. 26, 2005.

(30) Foreign Application Priority Data

Nov. 28, 2005 (KR) ..... 10-2005-0114049

(51) Int. Cl.
*H04R 5/02* (2006.01)
*H04R 5/00* (2006.01)

(52) U.S. Cl. ..... 381/309; 381/17; 381/1

(58) Field of Classification Search ..... 381/1, 17–22, 381/26, 300, 309, 310, 303, 74, 61, 332, 381/307; 700/94

See application file for complete search history.

(56) References Cited

U.S. PATENT DOCUMENTS

| | | | | |
|---|---|---|---|---|
| 4,060,696 | A | 11/1977 | Iwahara et al. | |
| 5,333,200 | A * | 7/1994 | Cooper et al. | 381/1 |
| 5,995,631 | A * | 11/1999 | Kamada et al. | 381/1 |
| 5,999,630 | A | 12/1999 | Iwamatsu | |
| 6,424,719 | B1 | 7/2002 | Elko et al. | |
| 6,668,061 | B1 * | 12/2003 | Abel | 381/1 |
| 7,164,768 | B2 * | 1/2007 | Aylward et al. | 381/22 |
| 2002/0015505 | A1 | 2/2002 | Katz | |

FOREIGN PATENT DOCUMENTS

| | | |
|---|---|---|
| EP | 0 740 487 | 10/1996 |
| JP | 2000-50399 | 2/2000 |

(Continued)

OTHER PUBLICATIONS

PCT Search Report dated Jan. 15, 2007 issued in KR 2006-3820.

(Continued)

*Primary Examiner* — Xu Mei
*Assistant Examiner* — Lun-See Lao
(74) *Attorney, Agent, or Firm* — Stanzione & Kim, LLP

(57) ABSTRACT

An apparatus and method for canceling crosstalk between 2-channel speakers and two ears of a listener in a stereo sound generation system. The crosstalk canceling apparatus includes a first signal processing unit to cross-mix first and second channel signals with gain and delay-adjusted first and second channel signals, a second signal processing unit to adjust frequency characteristics of the signals mixed in the first signal processing unit.

7 Claims, 5 Drawing Sheets

FOREIGN PATENT DOCUMENTS

| | | | |
|---|---|---|---|
| JP | 2002-34100 | | 1/2002 |
| JP | 2005-41900 | | 2/2005 |
| JP | 2005-168096 | | 6/2005 |
| KR | 2000-75880 | | 12/2000 |
| KR | 2001-47701 | * | 6/2001 |
| KR | 2005-12085 | | 1/2005 |
| KR | 2005-60789 | | 6/2005 |
| WO | WO 97/37514 | | 10/1997 |

OTHER PUBLICATIONS

Alastair Sibbald, "Transaural Acoustic Crosstalk Cancellation", Sensaura, 2001.
Dutch Search Report dated Apr. 3, 2008 issued in NL 1032569.
Korean Office Action dated Sep. 29, 2006 issued in KR 2005-114049.
Chinese Office Action issued Jul. 21, 2011 in CN Application No. 200610159512.8.

* cited by examiner

APPARATUS AND METHOD TO CANCEL CROSSTALK AND STEREO SOUND GENERATION SYSTEM USING THE SAME

CROSS-REFERENCE TO RELATED APPLICATIONS

This application claims the benefit of Korean Patent Application No. 10-2005-0114049, filed on Nov. 28, 2005, in the Korean Intellectual Property Office, and U.S. Provisional Application No. 60/720,043, filed on Sep. 26, 2005, the disclosures of which are incorporated herein in their entirety by reference.

BACKGROUND OF THE INVENTION

1. Field of the Invention

The present general inventive concept relates to a virtual sound system, and more particularly, to an apparatus and method to cancel crosstalk between 2-channel speakers and two ears of a listener and a stereo sound generation system using the same.

2. Description of the Related Art

A stereo sound system disposes a sound source in a predetermined position of a virtual space through a headphone or speaker and provides a directional perception, a distance perception, and a spatial perception as though a sound is actually being heard from a place at which a virtual sound source of the sound is located. Generally, a stereo sound is implemented by a binaural synthesis filter using a head related transfer function (HRTF) that is an acoustic transfer function between sound sources and eardrums. A stereo sound using the binaural synthesis filter shows the best performance when a signal is reproduced through a headphone. However, if the signal is reproduced through two speakers, crosstalk between the two speakers and two ears of a listener occur such that a stereo perception is degraded. Accordingly, a crosstalk canceller cancels the crosstalk between both signals so that a signal reproduced through a left speaker is not heard in a right ear of the listener and a signal reproduced through a right speaker is not heard in a left ear of the listener.

A technology related to this crosstalk canceller is described in U.S. Pat. No. 6,668,061 B1 (filed 18 Nov. 1998, entitled, "CROSSTALK CANCELLER").

FIG. 1 illustrates a conventional crosstalk canceller. The crosstalk canceller of FIG. 1 is called a lattice structure and includes four filters 142, 143, 144, and 145.

Referring to FIG. 1, a left input signal 140 ($B_L$) is convoluted through a filter 142, and a right input signal 141 ($B_R$) is convoluted through a filter 144. Subsequently, the two convoluted signals are added to each other by an adder 150 and reproduced as a left output signal 152 ($S_L$). In addition, the right input signal 141 ($B_R$) is convoluted through a filter 145, and the left input signal 140 ($B_L$) is convoluted through a filter 143. Subsequently, the two convoluted signals are added to each other by an adder 151 and reproduced as a right output signal 153 ($S_R$).

In the cross-talk canceling method illustrated in FIG. 1, a convolution operation is performed four times with respect to the four filters 142, 143, 144, and 145. Thus, a large amount of computation is required when the order of each filter is high. Accordingly, in the conventional crosstalk canceller, it is difficult to perform convolution in a time domain and convolution should be performed in a frequency domain. However, since convolution in the frequency domain requires a large-size memory, the size of a program must also be increased.

SUMMARY OF THE INVENTION

The present general inventive concept provides an apparatus and method to cancel a crosstalk phenomenon between 2-channel speakers and two ears of a listener and a stereo sound generation system using the same.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing an apparatus to cancel a crosstalk between two speakers and two ears of a listener, the apparatus including a delay unit to delay first and second channel input signals with respective predetermined delay values, a gain unit to adjust an output gain of each of the first and second channel input signals delayed in the delay unit, a first addition unit to add the first channel input signal to the gain and delay-adjusted second channel signal, a first filter unit to adjust a frequency characteristic of a signal output from the first addition unit, a second addition unit to add the second channel input signal to the gain and delay-adjusted first channel signal, and a second filter unit to adjust a frequency characteristic of a signal output from the second addition unit.

The foregoing and/or other aspects of the present general inventive concept are also achieved by providing an apparatus to cancel a crosstalk between two speakers and two ears of a listener, the apparatus including first and second filter units to adjust frequency characteristics of first and second channel signals, a delay unit to delay output signals of the first and second filter units with respective predetermined delay values, a gain unit to adjust an output level of each of the signals delayed in the delay unit, a first addition unit to add an output signal of the first filter unit to a gain and delay-adjusted output signal of the second filter unit, and a second addition unit to add an output signal of the second filter unit to a gain and delay-adjusted output signal of the first filter unit.

The foregoing and/or other aspects of the present general inventive concept are also achieved by providing a crosstalk canceling apparatus, including a gain/delay processing unit to receive first and second input channel signals, to apply a first gain and a first delay to the first input channel signal, to apply a second gain and a second delay to the second input channel signal, to add the gain/delayed first channel signal to the second input channel signal to obtain a first added signal, to add the gain/delayed second channel signal to the first input channel signal to obtain a second added signal, and to output the first and second added signals, and a filter unit to perform a first convolution operation to the first added signal and a second convolution operation to the second added signal and to output the first and second convoluted signals to first and second speakers, respectively.

The foregoing and/or other aspects of the present general inventive concept are also achieved by providing a crosstalk processing apparatus, including a filter unit to filter left and right channel signals associated with left and right channel speakers, respectively, and a gain/delay unit to process the filtered left channel signal by approximating a first head related transfer function for the left channel speaker and predetermining a first gain difference and a first delay difference between a right ear position and a left ear position in a sound space with respect to the left channel speaker, and to process the filtered right channel signal by approximating a second head related transfer function for the right channel speaker and predetermining a second gain difference and a second delay difference between the right ear position and the left ear position in the sound space with respect to the right channel speaker.

The foregoing and/or other aspects of the present general inventive concept are also achieved by providing a stereo sound production system, including first and second speakers, and a crosstalk canceling apparatus to cancel a crosstalk between the first and second speakers and two ears of a listener. The crosstalk canceling apparatus includes a first signal processing unit to cross-mix first and second channel signals with gain and delay-adjusted first and second channel signals, and a second signal processing unit to adjust frequency characteristics of the signals mixed in the first signal processing unit and to provide the signals with the adjusted frequency characteristics to the first and second speakers.

The foregoing and/or other aspects of the present general inventive concept are also achieved by providing a crosstalk canceling apparatus to generate a virtual sound without crosstalk between left and right channel speakers using the following predetermined relationship between acoustic transfer functions for each of the left and right speakers $$H_2(z) \approx \alpha z^{-\beta} H_1(z)$$

where $H_1(z)$ represents a first acoustic transfer function between a selected one of the left and right speakers and an ear that is closer to the selected speaker, $H_2(z)$ represents a second acoustic transfer function between the selected speaker and an ear that is distant from the selected speaker, $\alpha$ represents a gain difference between the selected speaker and the close and distant ears, and $\beta$ represents a delay difference between the selected speaker and the close and distant ears.

The foregoing and/or other aspects of the present general inventive concept are also achieved by providing a method of canceling crosstalk between two speakers and two ears of a listener, the method including inputting left and right channel signals binaural synthesized by a head related transfer function (HRTF), adjusting a gain and a delay of the left channel input signal, adjusting a gain and a delay of the right channel input signal, adding the left channel input signal to the gain and delay-adjusted right channel signal to obtain a first mixed signal, adjusting a frequency characteristic of the first mixed signal in an inverse HRTF form and outputting a result to a left speaker, adding the right channel input signal to the gain and delay-adjusted left channel signal to obtain a second mixed signal, and adjusting a frequency characteristic of the second mixed signal in an inverse HRTF form and outputting a result to a right speaker.

The foregoing and/or other aspects of the present general inventive concept are also achieved by providing a method of generating sound at a listening point using 2-channel speakers, the method including receiving first and second channel signals corresponding to first and second speakers, respectively, approximating a second head related transfer function between the first speaker and a second ear of a listener based on a first head related transfer function between the first speaker and a first ear of the listener, a corresponding first delay value, and a corresponding first gain value, approximating a fourth head related transfer function between the second speaker and the first ear of the listener based on a third head related transfer function between the second speaker and the second ear of the listener, a corresponding second delay value, and a corresponding second gain value, and processing the first and second channel signals according to the first, approximated second, third, and approximated fourth head related transfer functions to cancel crosstalk between the first and second speakers.

The foregoing and/or other aspects of the present general inventive concept are also achieved by providing a computer readable medium containing executable code to cancel a crosstalk between two speakers and two ears of a listener, the medium including first executable code to cross-mix first and second channel signals with gain and delay-adjusted first and second channel signals, and second executable code to adjust frequency characteristics of the signals mixed in the first signal processing unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
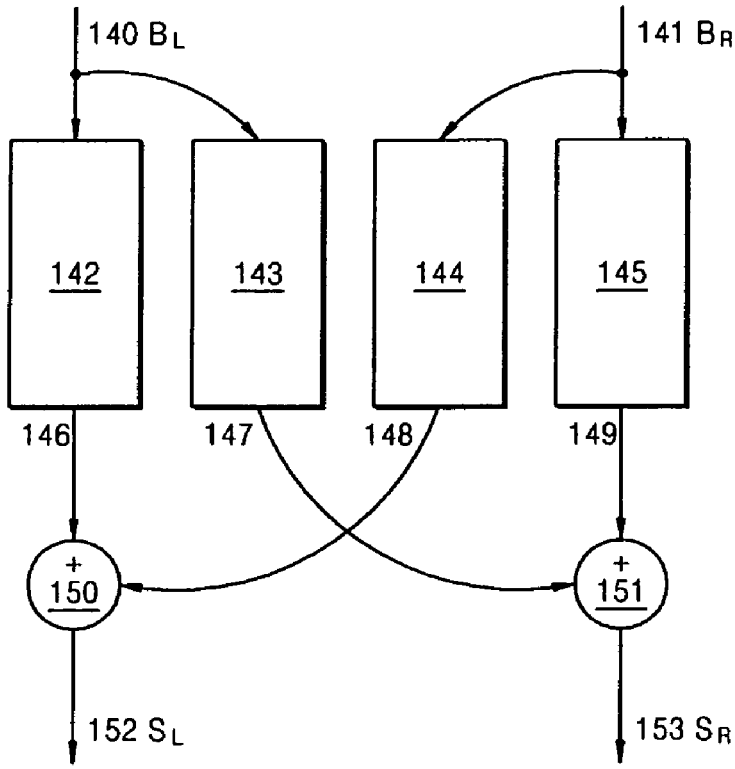
FIG. 1 (PRIOR ART)
FIG. 1 illustrates a conventional crosstalk canceller.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
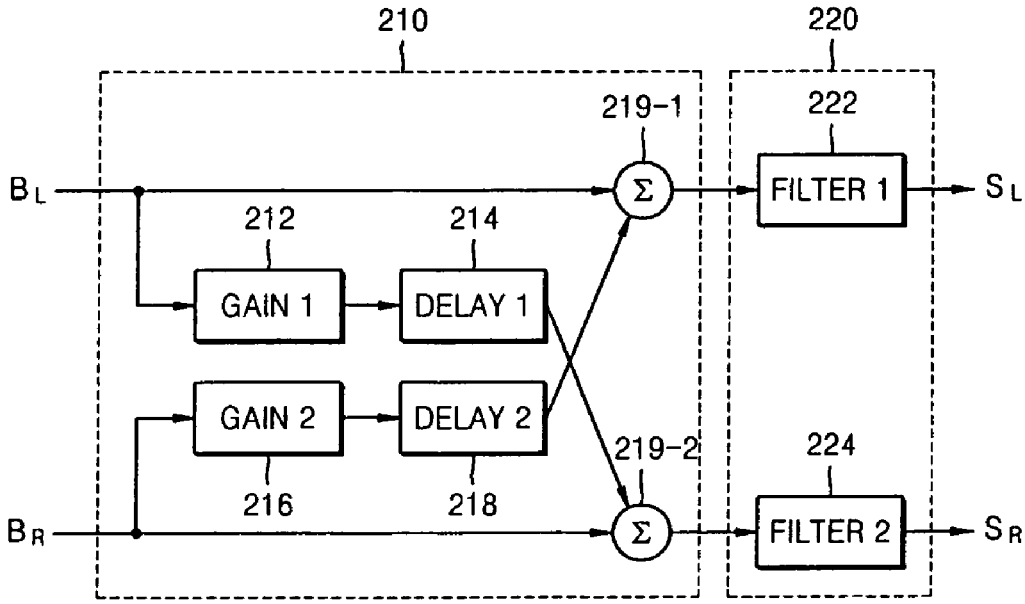
FIG. 2 illustrates an apparatus to cancel a crosstalk according to an embodiment of the present general inventive concept.

FIG. 2 illustrates an apparatus to cancel a crosstalk according to an embodiment of the present general inventive concept. The crosstalk canceling apparatus of FIG. 2 includes a first signal processing unit 210 and a second signal processing unit 220. The first signal processing unit 210 includes a first gain unit 212, a second gain unit 216, a first delay unit 214, a second delay unit 218, a first addition unit 219-1, and a second addition unit 219-2. The first signal processing unit 210 cross-mixes a left channel signal ($B_L$) and a right channel signal ($B_R$) with gain/delay-adjusted or delay/gain-adjusted left channel signal ($B_L$) and right channel signal ($B_R$). The second signal processing unit 220 includes a first filter unit 222 and a second filter unit 224. The second signal processing unit 220 adjusts frequency characteristics of each of the signals mixed in the first signal processing unit 210. The order of the first and second gain units 212 and 216 and the first and second delay units 214 and 218 can be changed according to the desired implementation. That is, in another embodiment of the crosstalk canceling apparatus, the first and second delay units 214 and 218 may be switched with the first and second gain units 212 and 216, respectively.

Referring to FIG. 2, the first gain unit 212 adjusts the gain of the left channel signal ($B_L$) being input with a first predetermined gain value.

The second gain unit 216 adjusts the gain of the right channel signal ($B_R$) being input with a second predetermined gain value.

The first delay unit 214 delays the left channel signal ($B_L$) gain-adjusted in the first gain unit 212 with a first predetermined delay value.

The second delay unit 218 delays the right channel signal ($B_R$) gain-adjusted in the second gain unit 216 with a second predetermined delay value.

The first addition unit 219-1 adds the left channel signal ($B_L$) being input to the first signal processing unit 210 to the right channel signal ($B_R$), which has been gain and delay-adjusted by the second gain unit 216 and the second delay unit 218.

The second addition unit 219-2 adds the right channel signal ($B_R$) being input to the first signal processing unit 210 to the left channel signal ($B_L$), which has been gain and delay-adjusted by the first gain unit 212 and the first delay unit 214.

The first filter unit 222 has an inverse HRTF form of an HRTF that is an acoustic transfer function between speakers and two ears of a listener, and adjusts the frequency characteristic of a signal mixed in the first addition unit 219-1. An output signal ($S_L$) of the first filter unit 222 is output to a left speaker.

The second filter unit 224 has the inverse HRTF form of the HRTF that is the acoustic transfer function between the speakers and the two ears of the listener, and adjusts the frequency characteristic of a signal mixed in the second addition unit 219-2. An output signal ($S_R$) of the second filter unit 224 is output to a right speaker.

The apparatus to cancel a crosstalk having an improved structure of FIG. 2 will be described with more detail with reference to FIGS. 3 through 8.

Figure 3:
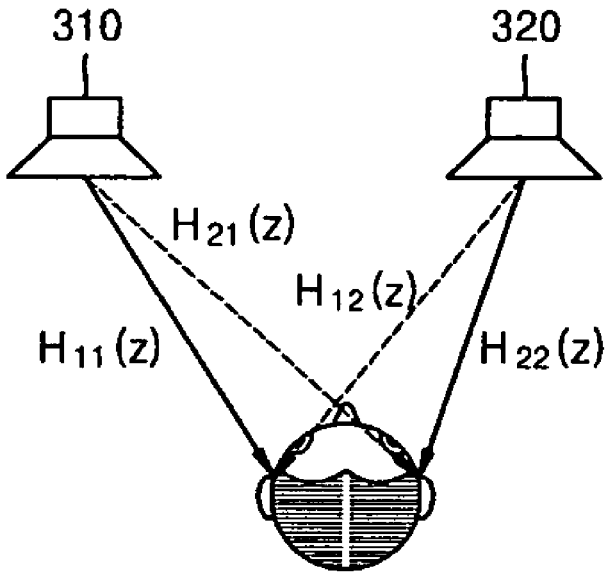
FIG. 3 illustrates a crosstalk phenomenon that occurs between two speakers and two ears of a listener.

Referring to FIG. 3, a crosstalk phenomenon between two speakers 310 and 320 and two ears of a listener occurs in many applied fields including a stereo sound.

Figure 4:
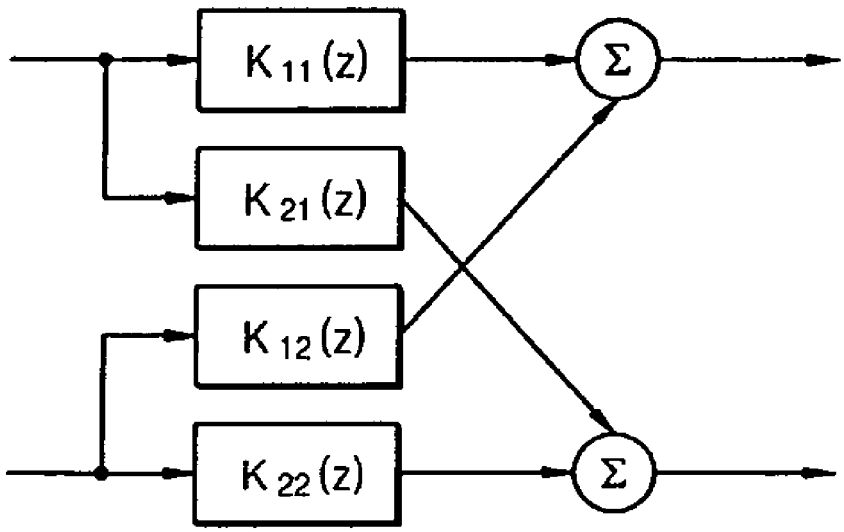
FIG. 4 illustrates a crosstalk canceller having a lattice structure for explaining the cancellation of the crosstalk phenomenon of FIG. 3 in more detail.

A crosstalk canceller cancels the crosstalk phenomenon by compensating for signals immediately before output signals are output to the two speakers 310 and 320. The crosstalk canceller is implemented as an inverse matrix of an HRTF matrix between the two speakers 310 and 320 and the two ears of the listener, as the following equation 1:

$$C(z) = H(z)^{-1} = \begin{bmatrix} H_{11}(z) & H_{12}(z) \\ H_{21}(z) & H_{22}(z) \end{bmatrix}^{-1} = \begin{bmatrix} H_{22}(z) & -H_{12}(z) \\ -H_{21}(z) & H_{11}(z) \end{bmatrix} \Big/ (H_{11}(z)H_{22}(z) - H_{12}(z)H_{21}(z)) \quad (1)$$

where $H_{11}(z)$, $H_{12}(z)$, $H_{21}(z)$, and $H_{22}(z)$, respectively, constitute the HRTF that is the acoustic transfer function between the two speakers and the two ears of the listener, as illustrated in FIG. 3. The crosstalk canceller has a secondary square matrix to generate two output signals in response to two input signals, and thus, is implemented as a structure illustrated in FIG. 4. Generally, the structure illustrated in FIG. 4 is referred to as a lattice structure. Here, $K_{11}(z)$, $K_{12}(z)$, $K_{21}(z)$, and $K_{22}(z)$, respectively, are elements of a secondary square matrix of equation 1.

Figure 5:
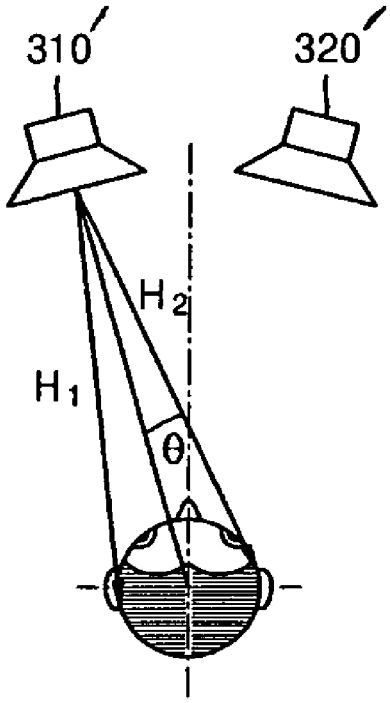
FIG. 5 illustrates head related transfer function (HRTF) pairs of adjacent loud speakers.

Basically, a stereo speaker system is mounted on current digital media products. In portable devices such as personal multimedia players (PMP) or personal digital assistants (PDA) as well as TVs, two speakers are adjacent to each other. FIG. 5 illustrates the stereo speaker system having the two speakers 310' and 320' adjacent to each other such that sounds approximately originate from the same location. As illustrated in FIG. 5, when speakers 310' and 320' are adjacent to each other, HRTF pairs ($H_1(z)$, $H_2(z)$) between the two ears of the listener in one speaker 310' have similar acoustic characteristics due to the fact that the sounds of the both speakers 310' and 320' originate from approximately the same location. The closer the two speakers 310' and 320' are to one another, the higher the correlation between $H_1(z)$ and $H_2(z)$. Here, $H_1(z)$ is an HRTF of an ear that is close to the speakers 310' and 320', and $H_2(z)$ is an HRTF of an ear that is distant from the speakers 310' and 320'.

Considering that the correlation between the HRTF pairs ($H_1(z)$, $H_2(z)$) is high, an assumption of the following equation 2 can be made $$H_2(z) \cong \alpha z^{-\beta} H_1(z) \quad (2)$$

That is, assuming that there is only a difference between a gain and a delay between $H_1(z)$ and $H_2(z)$, $H_2(z)$ can be obtained using equation 2 by adjusting the gain and the delay from $H_1(z)$. Here, a gain value ($\alpha$) is a level difference between the two HRTFs, and a delay value ($\beta$) is a delay difference between the two HRTFs. The level difference ($\alpha$) between the two HRTFs is obtained from the difference between maximum values of impulse responses of the two HRTFs ($H_1(z)$, $H_2(z)$) between the speakers 310' and 320' and the two ears of the listener, or the difference between root mean square (RMS) values. The delay difference ($\beta$) between the two HRTFs ($H_1(z)$, $H_2(z)$) is obtained from a time when a cross-correlation function of the impulse responses of the two HRTFs ($H_1(z)$, $H_2(z)$) between the speakers 310' and 320' and the two ears of the listener becomes a maximum.

Accordingly, when the two speakers 310 and 320 are disposed symmetrically about the listener as illustrated in FIG. 3, the crosstalk canceller is obtained by the above equation 1. When the two speakers 310' and 320' are disposed asymmetrically about the listener as illustrated in FIG. 5, the assumption of the following equations 3 and 4 can be made based on equation 2. HRTFs ($H_{21}(z)$, $H_{12}(z)$) about the ear that is distant from the speakers 310' and 320' can be obtained from HRTFs ($H_{11}(z)$, $H_{22}(z)$) about the ear that is close to the speakers 310' and 320' as indicated by the following equations 3 and 4:

$$H_{21}(z) \cong \alpha_1 z^{-\beta_1} H_{11}(z) \quad (3)$$

$$H_{12}(z) \cong \alpha_2 z^{-\beta_2} H_{22}(z) \quad (4)$$

where, $\alpha_1$ and $\alpha_2$ are a level difference between two HRTFs, and $\beta_1$ and $\beta_2$ are a delay difference between the two HRTFs, as mentioned in equation 2.

By using equations 3 and 4, equation 1 can be approximated as the following equation 5:

$$C(z) \cong \begin{bmatrix} C_{11}(z) & -\alpha_2 z^{-\beta_2} C_{11}(z) \\ -\alpha_1 z^{-\beta_1} C_{22}(z) & C_{22}(z) \end{bmatrix} = \begin{bmatrix} C_{11}(z) & 0 \\ 0 & C_{22}(z) \end{bmatrix} \begin{bmatrix} 1 & -\alpha_2 z^{-\beta_2} \\ -\alpha_1 z^{-\beta_1} & 1 \end{bmatrix} \quad (5)$$

where $$C_{11}(z) = \frac{H_{22}(z)}{H_{11}(z)H_{22}(z) - H_{12}(z)H_{21}(z)}$$

$$C_{22}(z) = \frac{H_{11}(z)}{H_{11}(z)H_{22}(z) - H_{12}(z)H_{21}(z)}$$

Figure 6:
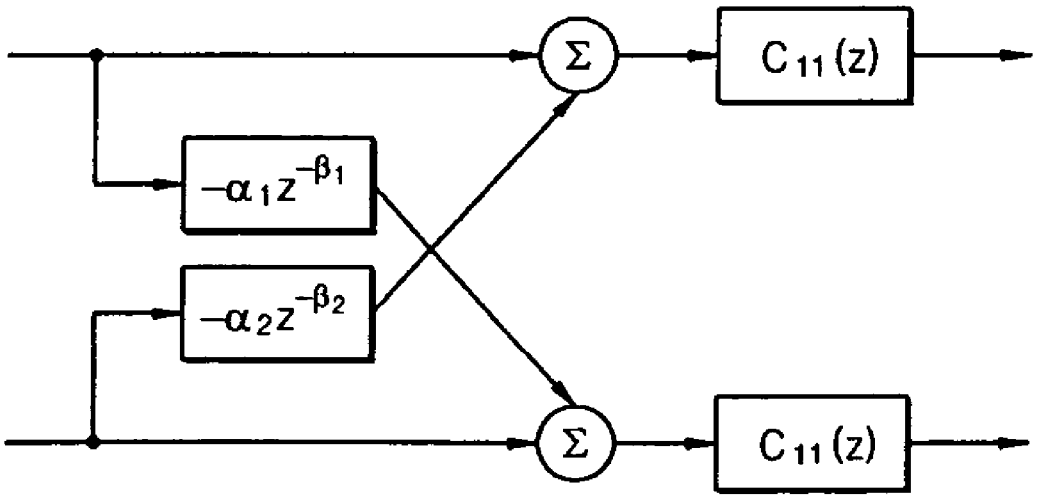
FIG. 6 illustrates an approximated asymmetrical crosstalk canceller, according to an embodiment of the present general inventive concept.

Equation 5 that represents the approximated crosstalk canceller can be expressed as the block diagram of FIG. 6.

Figure 7:
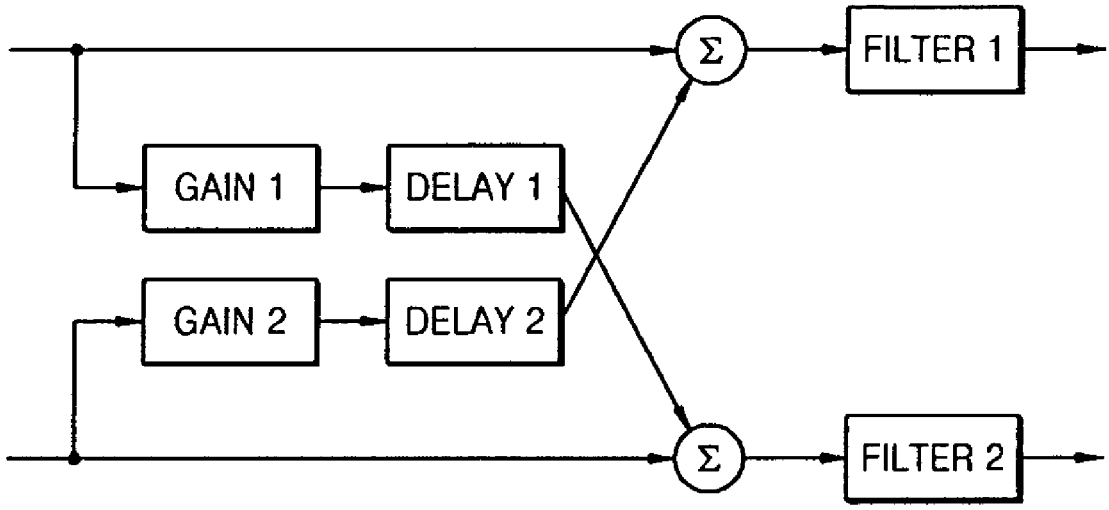
FIG. 7 is a block diagram illustrating the approximated asymmetrical crosstalk canceller of FIG. 6.

The block diagram of the crosstalk canceller of FIG. 6 can be expanded as the block diagram of FIG. 7. That is, the crosstalk canceller includes first and second gain units, first and second delay units, and first and second filters. As a result, while the crosstalk canceller of the lattice structure of FIG. 4 performs a convolution operation four times with respect to four filters, a crosstalk canceller of the present embodiment performs the convolution operation only twice with respect to the two filters such that the amount of computation and a size of a memory can be reduced.

Additionally, when the two speakers 310 and 320 are disposed symmetrically about the listener (FIG. 3), the symmetrical crosstalk canceller can employ the same method as the asymmetrical crosstalk canceller used when the two speakers 310' and 320' are disposed asymmetrically about the listener (FIG. 5).

A general crosstalk canceller becomes H11($z$)=H22($z$) and H21($z$)=H12($z$). Accordingly, the crosstalk canceller can be expressed as the following expression 6:

$$C(z) = H(z)^{-1} = \begin{bmatrix} H_1(z) & H_2(z) \\ H_2(z) & H_1(z) \end{bmatrix}^{-1} = \begin{bmatrix} H_1(z) & -H_2(z) \\ -H_2(z) & H_1(z) \end{bmatrix} \Big/ (H_1^2(z) - H_2^2(z)) \quad (6)$$

By using an assumption of the following equation 7, equation 6 is approximated as equation 8 (below):

$$H_2(z) \cong \alpha z^{-\beta} H_1(z) \quad (7)$$

$$C(z) \cong C_1(z) \begin{bmatrix} 1 & -\alpha z^{-\beta} \\ -\alpha z^{-\beta} & 1 \end{bmatrix}, \text{ where } C_1(z) = \frac{H_1(z)}{H_1^2(z) - H_2^2(z)} \quad (8)$$

Figure 8:
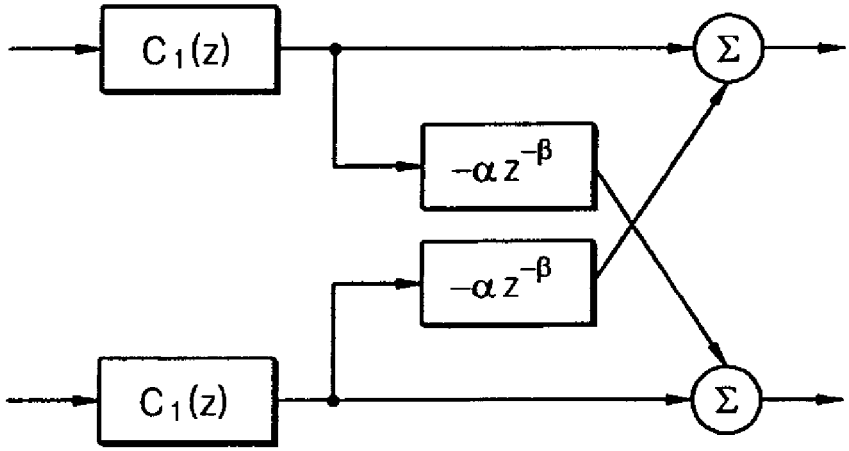
FIG. 8 illustrates an approximated symmetrical crosstalk canceller, according to an embodiment of the present general inventive concept.

Equation 8 represents an approximated symmetrical crosstalk canceller and can be expressed as the block diagram of FIG. 8. The approximated symmetrical crosstalk canceller of the block diagram of FIG. 8 can be expanded as the block diagram of a symmetrical crosstalk canceller of FIG. 9.

Figure 9:
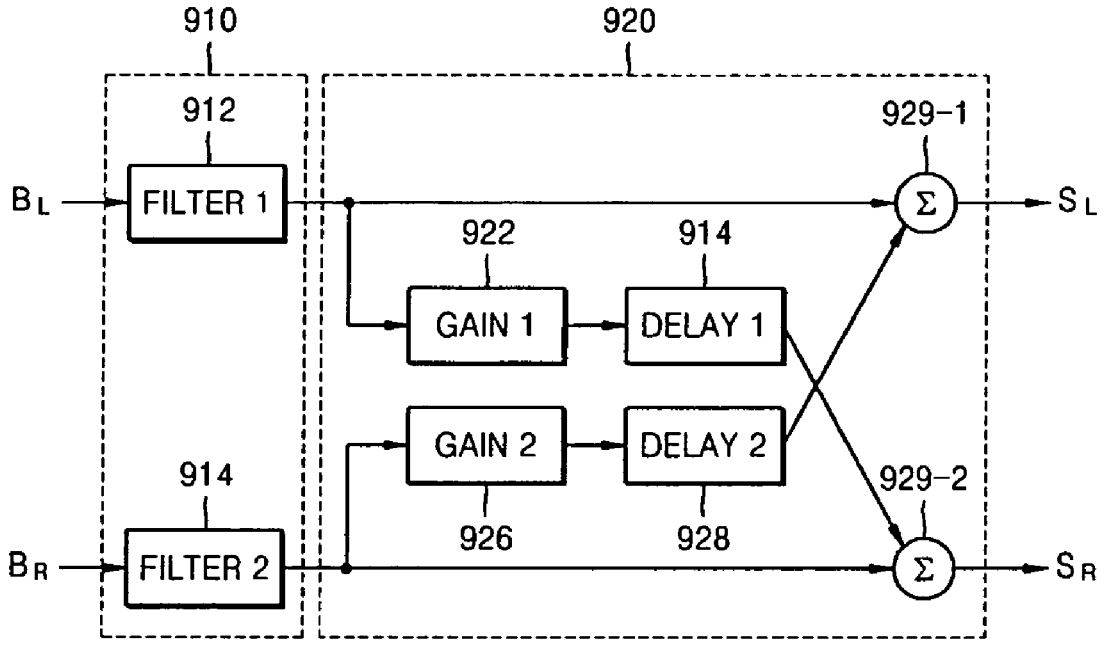
FIG. 9 is a block diagram illustrating the approximated symmetrical crosstalk canceller of FIG. 8, according to an embodiment of the present general inventive concept.

Referring to FIG. 9, the symmetrical crosstalk canceller includes a first signal processing unit 910 and a second signal processing unit 920. The first signal processing unit 910 includes first and second filter units 912 and 914 to adjust frequency characteristics of input left and right channel signals $B_L$ and $B_R$, respectively.

The second signal processing unit 920 includes first and second gain units 922 and 926 to adjust gains of output signals of the first and second filter units 912 and 914, respectively, with predetermined gain values. The second signal processing unit 920 further includes first and second delay units 924 and 928 to delay the signals that are gain-adjusted in the first and second gain units 922 and 926, respectively, with predetermined delay values. A first addition unit 929-1 adds an output signal of the first filter unit 912 and a gain and delay-adjusted output signal of the second filter unit 914. A second addition unit 929-2 adds an output signal of the second filter unit 914 and a gain and delay-adjusted output signal of the first filter unit 912.

The symmetrical crosstalk canceller in which the first filter unit 912 (i.e., C1($z$)) is connected to an input terminal, as illustrated in FIGS. 8 and 9, and the asymmetrical crosstalk canceller in which the first and second filter units (i.e., C11($z$),C22($z$)) are connected to an output terminal, as illustrated in FIG. 7, produce about the same result.

As a result, the crosstalk canceller of the embodiments of the present general inventive concept are represented by FIGS. 7 and 9. As illustrated in FIGS. 7 and 9, in the crosstalk canceller of the present embodiment compared to the conventional lattice structure, a number of filters is reduced (from 4 to 2) such that the convolution operation is performed only twice and remaining signals can be processed using simple gain values and simple delay values. Accordingly, in the crosstalk canceller according to the embodiments of the present general inventive concept, an amount of computation required in the conventional crosstalk canceller structure can be decreased by 50%. In addition, since the number of filters is reduced, a size of a memory can be reduced.

It should be understood that although the embodiments of the present general inventive concept have been described with reference to a listener and two ears of the listener, the crosstalk canceller of the embodiments of the present general inventive concept may be used to cancel crosstalk occurring about a listening point of a stereo sound generation system and/or a virtual surround system. The listening point may refer to a position where a listener perceives optimal stereo effect, and this can be approximated using, for example, a dummy head. Thus, a listener need not necessarily be present when the crosstalk canceller and the stereo sound generation system operate.

In another embodiment of the present general inventive concept, gain units, delay units, and filter units in a crosstalk canceller can be obtained directly not only from HRTFs using equations 1 through 8, but also from the conventional lattice structure. For example, as illustrated in FIG. 4, if there are four filter coefficients (K11($z$), K12($z$), K21($z$), K22($z$)) of a lattice structure designed in advance, the gain units, the delay units, and the filter units can be obtained from the four filter coefficients (K11($z$), K12($z$), K21($z$), K22($z$)). That is, referring to FIG. 7, the first filter unit becomes K11($z$) and the second filter unit becomes K22($z$). The first gain unit and the first delay unit are obtained from a time when a difference of maximum values (or RMS values) between the filter coefficients K22($z$) and K21($z$) and a cross-correlation function of the filter coefficients K22($z$) and K21($z$) becomes a maximum. The second gain unit and the second delay unit are obtained from a time when a difference of maximum values (or RMS values) between the filter coefficients K11($z$) and K12($z$) and a cross-correlation function of the filter coefficients K11($z$) and K12($z$) becomes a maximum.

In another embodiment of the present general inventive concept, a widening filter based on a filter infinite impulse response filter (IIR) is designed by performing convolution of a binaural synthesis portion and a crosstalk canceller in a stereo sound generation system. When a number of virtual speakers is 2N, the binaural synthesis portion may be a square matrix of the size of 2 and the crosstalk canceller portion may also be a square matrix of the size of 2 such that the widening filter becomes a square matrix of the size of 2 which is a matrix form obtained by multiplying the two matrices corresponding to the binaural synthesis portion and the crosstalk canceller portion. Accordingly, the structure illustrated in FIGS. 7 and 9 can also be applied to the stereo sound generation apparatus to perform convolution of a square matrix structure of the size of 2 in relation to 2-channel input signals.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present general inventive concept can be easily construed by programmers skilled in the art to which the present general inventive concept pertains.

According to embodiments of the present general inventive concept as described above, a crosstalk phenomenon between two speakers and two ears of a listener is cancelled such that a desired performance in many applied fields including a stereo sound system can be maximized. In addition, in a crosstalk canceller according to the embodiments of the present general inventive concept, a number of filters is reduced from 4 to 2 from a conventional lattice structure and a convolution is performed only twice such that an amount of computation and a size of a memory can be reduced by 50% from the conventional lattice structure.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus to cancel asymmetrical crosstalk between two speakers and two ears of a listener, the apparatus comprising:

a first signal processing unit to input left and right channel signals binaural synthesized by a head related transfer function (HRTF), adjust a gain and a delay of the left channel input signal, adjust a gain and a delay of the right channel input signal, add the left channel input signal to the gain and delay adjusted right channel input signal to obtain a first mixed signal, and add the right channel input signal to the gain and delay adjusted left channel signal to obtain a second mixed signal; and a second signal processing unit to adjust a frequency characteristic of the first mixed signal in an inverse HRTF form and output a result to a left speaker, and adjust a frequency characteristic of the second mixed signal in the inverse HRTF form and output a result to the right speaker, wherein the gain values are determined by a difference between maximum values of impulse responses of a first HRTF and a second HRTF between the speakers and the ears, wherein the delay values are determined by a time when a cross-correlation function of impulse responses of the first HRTF and the second HRTF between the speakers and the two ears becomes a maximum.

2. The apparatus of claim 1, wherein the gain values are determined by a difference between maximum values of impulse responses of two filters of a pre-designed lattice structure.

3. The apparatus of claim 1, wherein the delay values are determined by a time when a cross-correlation function of impulse responses of two filters of a pre-designed lattice structure becomes a maximum.

4. A stereo sound production system, comprising:

left and right speakers; and a crosstalk canceling apparatus to cancel a crosstalk between the left and right speakers and two ears of a listener, including a first signal processing unit to input left and right channel signals binaural synthesized by a head related transfer function (HRTF), adjust a gain and a delay of the left channel input signal, adjust a gain and a delay of the right channel input signal, add the left channel input signal to the gain and delay-adjusted right channel input signal to obtain a first mixed signal, and add the right channel input signal to the gain and delay adjusted left channel signal to obtain a second mixed signal, and a second signal processing unit to adjust a frequency characteristic of the first mixed signal in an inverse HRTF form and output a result to a left speaker, and adjust a frequency characteristic of the second mixed signal in the inverse HRTF form and output a result to the right speaker, wherein the gain values are determined by a difference between maximum values of impulse responses of a first HRTF and a second HRTF between the speakers and the ears, wherein the delay values are determined by a time when a cross-correlation function of impulse responses of the first HRTF and the second HRTF between the speakers and the ears becomes a maximum.

5. The system of claim 4, wherein the left and right speakers are symmetrically arranged with respect to each other and a listening point of the system.

6. The system of claim 4, wherein the left and right speakers are asymmetrically arranged adjacent to one another with respect to a listening point of the system.

7. A method of canceling asymmetrical crosstalk between two speakers and two ears of a listener, the method comprising:

inputting left and right channel signals binaural synthesized by a head related transfer function (HRTF);

adjusting a gain and a delay of the left channel input signal;

adjusting a gain and a delay of the right channel input signal;

adding the left channel input signal to the gain and delay-adjusted right channel signal to obtain a first mixed signal;

adjusting a frequency characteristic of the first mixed signal in an inverse HRTF form and outputting a result to a left speaker;

adding the right channel input signal to the gain and delay-adjusted left channel signal to obtain a second mixed signal; and adjusting a frequency characteristic of the second mixed signal in the inverse HRTF form and outputting a result to a right speaker, wherein the gain values are determined by a difference between maximum values of impulse responses of a first HRTF and a second HRTF between the speakers and the ears, wherein the delay values are determined by a time when a cross-correlation function of impulse responses of the first HRTF and the second HRTF between the speakers and the ears becomes a maximum.

* * * * *